US012173723B2

(12) United States Patent
Sato et al.

(10) Patent No.: US 12,173,723 B2
(45) Date of Patent: Dec. 24, 2024

(54) DRAINAGE PUMP

(71) Applicant: FUJIKOKI CORPORATION, Tokyo (JP)

(72) Inventors: Katsushi Sato, Tokyo (JP); Yoshiki Watanabe, Tokyo (JP)

(73) Assignee: FUJIKOKI CORPORATION, Tokyo (JP)

( * ) Notice: Subject to any disclaimer, the term of this patent is extended or adjusted under 35 U.S.C. 154(b) by 43 days.

(21) Appl. No.: 17/998,869

(22) PCT Filed: May 19, 2021

(86) PCT No.: PCT/JP2021/018893

§ 371 (c)(1),
(2) Date: Nov. 15, 2022

(87) PCT Pub. No.: WO2021/241341

PCT Pub. Date: Dec. 2, 2021

(65) Prior Publication Data

US 2023/0193925 A1 Jun. 22, 2023

(30) Foreign Application Priority Data

May 26, 2020 (JP) ..... 2020-091206

(51) Int. Cl.
*F04D 29/22* (2006.01)
*F04D 7/04* (2006.01)
(Continued)

(52) U.S. Cl.
CPC ..... *F04D 29/2277* (2013.01); *F04D 7/045* (2013.01); *F04D 13/06* (2013.01);
(Continued)

(58) Field of Classification Search
CPC .... F04D 29/2277; F04D 13/06; F04D 29/669; F04D 29/426; F04D 29/628; F04D 29/242; F04D 7/045
See application file for complete search history.

(56) References Cited

U.S. PATENT DOCUMENTS 2,811,110 A * 10/1957 Lowell ..... F04D 29/2277 96/217
5,257,911 A * 11/1993 Mota ..... F04D 15/0218 417/63
(Continued)

FOREIGN PATENT DOCUMENTS

JP S54-21201 U1 2/1979
JP S59-154897 U 10/1984
(Continued)

OTHER PUBLICATIONS

Office Action dated Aug. 22, 2023, for the corresponding Japanese Application No. 2020-091206, with English translation.
(Continued)

*Primary Examiner* — Peter J Bertheaud
(74) *Attorney, Agent, or Firm* — LUCAS & MERCANTI, LLP

(57) ABSTRACT

To provide a drainage pump capable of reducing the amount of drain water remaining in a drain pan. A drainage pump includes a housing, an impeller housed in the housing, and a motor with a drive shaft connected to the impeller. The housing includes a suction pipe in a cylindrical shape extending in an up-and-down direction. A suction port facing downward and a concave surface in an annular shape around the suction port are disposed at a lower end of the suction pipe.

5 Claims, 3 Drawing Sheets

(51) Int. Cl.

| | |
|---|---|
| ***F04D 13/06*** | (2006.01) |
| ***F04D 29/24*** | (2006.01) |
| ***F04D 29/42*** | (2006.01) |
| ***F04D 29/62*** | (2006.01) |
| ***F04D 29/66*** | (2006.01) |

(52) U.S. Cl.
CPC ..... *F04D 29/242* (2013.01); *F04D 29/426* (2013.01); *F04D 29/628* (2013.01); *F04D 29/669* (2013.01)

(56) References Cited

U.S. PATENT DOCUMENTS

| | | | | |
|---|---|---|---|---|
| 5,605,439 | A * | 2/1997 | Endoh | F04D 29/669 416/201 A |
| 5,816,775 | A * | 10/1998 | Imai | F04D 29/669 416/223 R |
| 5,961,283 | A * | 10/1999 | Imai | F04D 29/445 415/206 |
| 7,670,105 | B2 * | 3/2010 | Nakata | F04D 29/242 416/201 A |
| 8,747,071 | B2 * | 6/2014 | Kato | F04D 29/669 416/185 |
| 2011/0008153 | A1 | 1/2011 | Kato et al. | |

FOREIGN PATENT DOCUMENTS

| | | | |
|---|---|---|---|
| JP | H04-107496 | U1 | 9/1992 |
| JP | 2011017262 | A | 1/2011 |
| JP | 2011-144691 | A | 7/2011 |
| JP | 5422277 | B2 | 2/2014 |
| WO | 2011086775 | A | 7/2011 |

OTHER PUBLICATIONS

International Search Report for the corresponding application No. PCT/JP2021/018893, dated Jul. 20, 2021, with English translation.
Written Opinion of the ISA for the corresponding application No. PCT/JP2021/018893, dated Jul. 20, 2021, with English translation.
Notice of Reasons for Refusal dated Jan. 9, 2024 for the corresponding Japanese Application No. 2020-091206, with English translation (7 pages).
European Patent Office, "Extended European Search Report" dated May 22, 2024 in connection with the related European patent application No. 21814373.3, 5 pages.
Korean Office Action mailed May 24, 2024, for the related Korean application No. 10-2022-7039739, with English machine translation, 6 pages.

* cited by examiner

DRAINAGE PUMP

CROSS REFERENCE TO RELATED APPLICATION

This Application is a 371 of PCT/JP2021/018893 filed on May 19, 2021 which, in turn, claimed the priority of Japanese Patent Application No. 2020-091206 filed on May 26, 2020, and both applications are incorporated herein by reference.

TECHNICAL FIELD

The present invention relates to a drainage pump for discharging, for example, drain water in an air conditioner.

BACKGROUND ART

Patent Literature 1 discloses an example of a drainage pump of the related art. The drainage pump in Patent Literature 1 includes a housing, and an impeller housed in the housing. The housing includes a suction pipe extending in an up-and-down direction. The suction pipe includes a suction port facing downward. The suction port is disposed at the lower end of the suction pipe.

CITATION LIST

Patent Literature

Patent Literature 1: Japanese Patent No. 5422277

SUMMARY OF INVENTION

Technical Problem

The drainage pump suctions up, through the suction port, drain water collected in a drain pan. However, the drainage pump cannot suction up all the drain water in the drain pan because a gap should be left between the suction port and the drain pan. Consequently, the drain water remains in the drain pan, and slime may be formed in the drain water.

In view of this, it is an object of the present invention to provide a drainage pump capable of reducing the amount of the drain water remaining in the drain pan.

Solution to Problem

The inventors of the present invention focused on a suction pipe of a drainage pump. The inventors found that surface tension raises drain water from its water surface to the lower end of the suction pipe, and the position of the water surface of the drain water remaining in a drain pan is lower than the lower end of the suction pipe when the drainage pump cannot suction up any more drain water from the drain pan in a drainage operation to discharge the drain water, i.e., when the drain water is suctioned up and retained in a housing of the drainage pump without falling (hereinafter referred to as "balanced state"). Therefore, the inventors made an intensive study of the shape of the suction pipe and came up with the present invention.

To solve the problem described above, a drainage pump according to the present invention includes a housing, an impeller housed in the housing, and a motor with a drive shaft connected to the impeller. The housing includes a suction pipe in a cylindrical shape extending in an up-and-down direction. The suction pipe includes a suction port facing downward and a concave surface in an annular shape around the suction port. The suction port and the concave surface are disposed at a lower end of the suction pipe.

In the present invention, a width at the lower end of the suction pipe in a radial direction (thickness of the suction pipe) is preferably greater than or equal to 2.5 mm and less than or equal to 8 mm.

Advantageous Effects of Invention

The drainage pump according to the present invention includes the suction pipe in the cylindrical shape extending in the up-and-down direction. The suction pipe includes the suction port facing downward and the concave surface in the annular shape around the suction port. The suction port and the concave surface are disposed at the lower end of the suction pipe. As a result, the drain water can be raised to a higher position due to increased surface tension acting on the drain water by the concave surface of the drainage pump. Therefore, the drainage pump can suction up the drain water to further lower the position of the water surface of the drain water in the drain pan and effectively reduce the amount of the drain water remaining in the drain pan.

DESCRIPTION OF EMBODIMENTS

Hereinafter, a drainage pump according to an embodiment of the present invention is described with reference to FIGS. 1A-1B and FIG. 2.

Figure 1A:
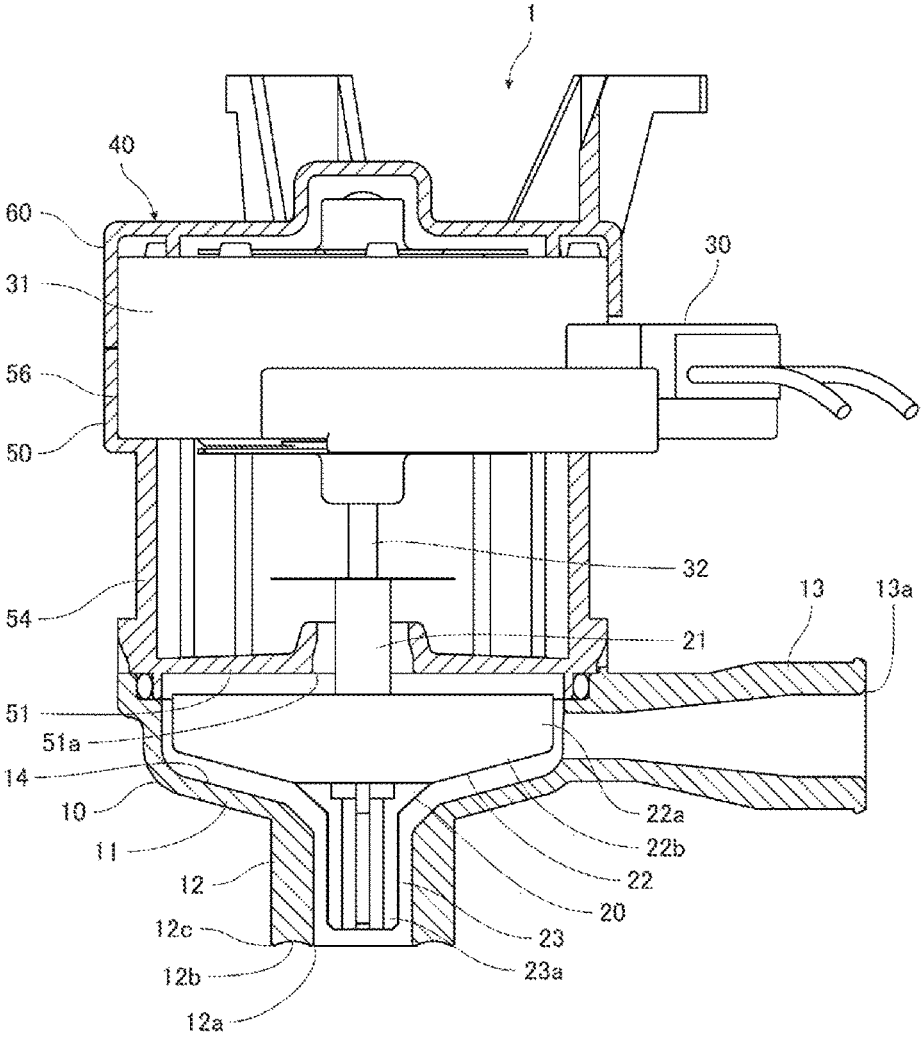
FIG. 1A illustrates a sectional view of a drainage pump according to an embodiment of the present invention.
Figure 1B:
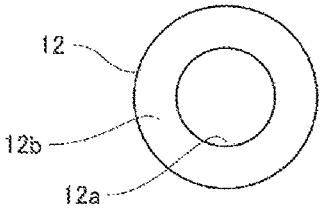
FIG. 1B illustrates a bottom view of a suction pipe according to an embodiment of the present invention.
Figure 2:
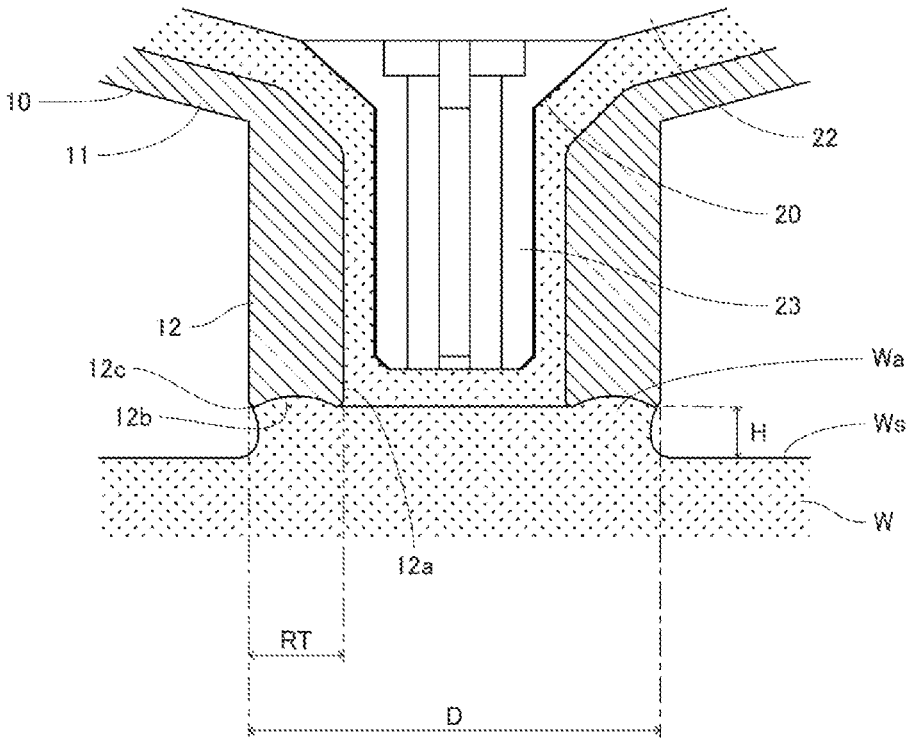
FIG. 2 is an enlarged sectional view of the lower end of a suction pipe of the drainage pump in FIG. 1A.

FIGS. 1A-1B illustrate the drainage pump according to the embodiment of the present invention. FIG. 1A is a sectional view of the drainage pump. In FIG. 1A, only a housing and a motor case are illustrated in section. FIG. 1B illustrates a suction pipe in a bottom view. FIG. 2 is an enlarged sectional view of the lower end of the suction pipe of the drainage pump in FIG. 1A.

The drainage pump according to the embodiment discharges outside, for example, drain water collected in a drain pan of an indoor unit of an air conditioner. Usage of the drainage pump is not limited to discharging the drain water. The drainage pump may be used for suctioning up or discharging various liquids in containers.

As illustrated in FIG. 1A, a drainage pump 1 according to an embodiment of the present invention includes a housing 10, an impeller 20, a motor 30, and a motor case 40. The housing 10, the impeller 20, and the motor case 40 are made of synthetic resin.

The housing 10 includes a main body 11 in a substantially inverted truncated conical shape. A suction pipe 12 extends downward from the main body 11. The suction pipe 12 has a cylindrical shape extending linearly in an up-and-down direction. The suction pipe 12 has a suction port 12*a* facing downward. The suction port 12*a* is disposed at a lower end 12*c* of the suction pipe 12. The suction pipe 12 has a concave surface 12*b* in a circular annular shape. The concave surface 12*b* is disposed at the lower end 12*c* of the suction pipe 12. The concave surface 12*b* is around the suction port 12*a*. A discharge pipe 13 extends from the main body 11 in a lateral direction. The discharge pipe 13 has a discharge port 13*a* facing the lateral direction. The discharge pipe 13 has a cylindrical shape extending linearly in the lateral direction. Alternatively, the discharge pipe 13 may have an arc shape or be substantially L-shaped, with the discharge port 13*a* facing upward. The suction pipe 12 and the discharge pipe 13 are connected to a pump chamber 14 inside the main body 11.

An outer diameter D of the lower end 12*c* of the suction pipe 12 is preferably greater than or equal to 16 mm and less than or equal to 25 mm. A width RT at the lower end of the suction pipe 12 in the radial direction (thickness of the suction pipe 12) is preferably greater than or equal to 2.5 mm and less than or equal to 8 mm. The width RT is also the width of the concave surface 12*b*. If the outer diameter D is less than 16 mm, the width of the concave surface 12*b* cannot be obtained enough, and a height H of a portion Wa of drain water W raised from a water surface Ws by surface tension is small. If the outer diameter D is greater than 25 mm, the suction pipe 12 is in contact with a water collection basin for drain water provided in the drain pan. With the outer diameter D greater than or equal to 16 mm and less than or equal to 25 mm in the drainage pump 1, the height H of the portion Wa of the drain water W is obtained enough by the surface tension, and the suction pipe 12 is inhibited from being in contact with the water collection basin of the drain pan. Consequently, the drain water W remaining in the drain pan can be effectively reduced. If the width RT in the drainage pump is less than 2.5 mm, high surface tension by the concave surface 12*b* cannot be obtained. If the width RT in the drainage pump is greater than 8 mm, the outer diameter D is large, and the suction pipe 12 may be in contact with the water collection basin as above.

The impeller 20 includes a shaft portion 21, a large-diameter blade portion 22, and a small-diameter blade portion 23. The shaft portion 21 has a circular columnar shape. The large-diameter blade portion 22 has a plurality of large-diameter blades (not illustrated) in a flat plate shape extending radially from the shaft portion 21. The large-diameter blade portion 22 has a ring 22*a* in a cylindrical shape connecting the tip ends of the large-diameter blades and a lower plate 22*b* in an annular shape of which the outer peripheral edge is connected to the lower end of the ring 22*a*. The large-diameter blade portion 22 is disposed in the pump chamber 14. The small-diameter blade portion 23 has a plurality of small-diameter blades 23*a* in a flat plate shape. The small-diameter blades 23*a* extend downward from the lower ends of the large-diameter blades through the inside of the lower plate 22*b*. The small-diameter blade portion 23 is disposed in the suction pipe 12.

The motor 30 is disposed above the housing 10. The motor 30 has a motor body 31 and a drive shaft 32 extending downward from the motor body 31. The drive shaft 32 is connected to the shaft portion 21 of the impeller 20.

The motor case 40 is mounted to the housing 10 by a snap-fit mechanism. The motor case 40 has a lower case 50 and an upper case 60.

The lower case 50 has a bottom wall portion 51, a peripheral wall portion 54, and a motor support portion 56.

The bottom wall portion 51 has a circular plate shape. The bottom wall portion 51 closes an upper end opening of the main body 11 of the housing 10. The bottom wall portion 51 defines the pump chamber 14 together with the main body 11. A shaft hole 51*a* is provided in the center of the bottom wall portion 51. The shaft portion 21 of the impeller 20 is disposed in the shaft hole 51*a*.

The peripheral wall portion 54 has a cylindrical shape. The lower end of the peripheral wall portion 54 is connected to the bottom wall portion 51. The peripheral wall portion 54 extends upward from the bottom wall portion 51. The motor support portion 56 is connected to the upper end of the peripheral wall portion 54.

The upper case 60 is mounted to the motor support portion 56 by a snap-fit mechanism. The upper case 60 covers an upper part of the motor 30. The motor case 40 houses the motor 30 in a space between the motor support portion 56 and the upper case 60. Parts of wires or others of the motor 30 are disposed outside the motor case 40.

As described above, the drainage pump 1 according to the embodiment includes the suction pipe 12 in the cylindrical shape extending in the up-and-down direction. The suction pipe 12 includes the suction port 12*a* facing downward and the concave surface 12*b* in the annular shape around the suction port 12*a*. The suction port 12*a* and the concave surface 12*b* are disposed at the lower end 12*c* of the suction pipe 12. As a result, the drainage pump 1 can raise the drain water W to a higher position by the surface tension. Therefore, the drainage pump 1 can suction up the drain water W to further lower the position of the water surface of the drain water in the drain pan and effectively reduce the amount of the drain water W remaining in the drain pan.

The embodiment of the present invention is described above. The present invention, however, is not limited to the embodiment. Embodiments obtained by appropriately adding, removing, or modifying components according to the embodiment described above by a person skilled in the art, and an embodiment obtained by appropriately combining features of the embodiment are included in the scope of the present invention as long as they have the gist of the present invention.

The inventors verified the effects of the present invention by measuring the position of the water surface of the drain water relative to the lower end of the suction pipe in the balanced state using Example 1 according to the present invention and Comparative examples 1 and 2.

Example 1 has the same configuration as the drainage pump 1 described above. In Example 1, the outer diameter D of the lower end of the suction pipe is 20.0 mm. The suction pipe has the concave surface in the circular annular shape around the suction port. The width RT at the lower end of the suction pipe in the radial direction is 4.5 mm.

In Comparative example 1, the outer diameter D and the width RT at the lower end of the suction pipe are the same as those of Example 1. However, Comparative example 1 differs from Example 1 in that the suction pipe has a flat surface in a circular annular shape around the suction port. Comparative example 1 has the same configuration as Example 1 except the suction pipe.

In Comparative example 2, the outer diameter D of the lower end of the suction pipe is 16.0 mm. The suction pipe has a flat surface in a circular annular shape around the suction port. Additionally, the width RT at the lower end of the suction pipe of Comparative example 2 in the radial direction is 2.5 mm and is narrower than that of Comparative example 1. Comparative example 2 has the same configuration as Example 1 except the suction pipe.

Figure 3:
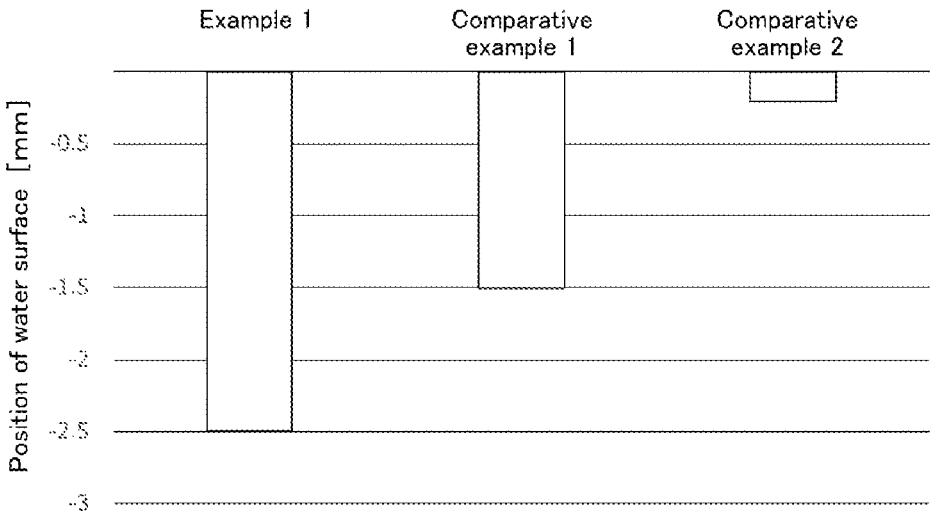
FIG. 3 is a graph showing the positions of water surfaces relative to the lower end of the suction pipe of the drainage pump in a balanced state.

The inventors used Example 1 and Comparative examples 1 and 2 to discharge the drain water W from the drain pan and measured the position of the water surface of the drain water W in the drain pan relative to the lower end of the suction pipe when the drainage pump was in the balanced state. The inventors measured the position of the water surface three times for each of Example 1 and Comparative examples 1 and 2 and calculated average values. Table 1 shows suction pipe configurations and measurement results of Example 1 and Comparative examples 1 and 2. FIG. 3 shows the measurement results. FIG. 3 is a graph showing the positions of the water surfaces (average value) relative to the lower end of the suction pipe in the balanced state.

TABLE 1

| | Suction pipe configuration | | | Position of water surface relative to lower end of suction pipe | | | |
|---|---|---|---|---|---|---|---|
| | Suction pipe outer diameter D | Suction pipe width RT | Shape around suction port | 1st | 2nd | 3rd | Average value |
| Example 1 | 20.0 | 4.5 | Concave surface | −2.3 | −2.5 | −2.7 | −2.5 |
| Comparative example 1 | 20.0 | 4.5 | Flat surface | −1.5 | −1.4 | −1.6 | −1.5 |
| Comparative example 2 | 16.0 | 2.5 | Flat surface | −0.2 | −0.3 | −0.1 | −0.2 |

Unit: m m

The measurement results of Comparative examples 1 and 2 show that increasing the width of the flat surface around the suction port allows the position of the water surface of the drain water in the drain pan to be lower. Additionally, the measurement results of Example 1 and Comparative example 1 show that changing the shape around the suction port from the flat surface to the concave surface allows the position of the water surface of the drain water in the drain pan to be further lower. In other words, a drainage pump with a concave surface in a circular annular shape around its suction port can lower the position of the water surface of the drain water in the drain pan compared to a drainage pump with a flat surface in a circular annular shape around its suction port.

This shows that the effects of the present invention are also evident in the verification of using actual drainage pumps.

REFERENCE SIGNS LIST

1: drainage pump, 11: main body, 12: suction pipe, 12*a*: suction port, 12*b*: concave surface, 12*c*: lower end, 13: discharge pipe, 13*a*: discharge port, 14: pump chamber, 10: housing, 20: impeller, 21: shaft portion, 22: large-diameter blade portion, 22*a*: ring, 22*b*: lower plate, 23: small-diameter blade portion, 23*a*: small-diameter blade, 30: motor, 31: motor body, 32: drive shaft, 40: motor case, 50: lower case, 51: bottom wall portion, 51*a*: shaft hole. 54: peripheral wall portion, 56: motor support portion, 60: upper case, W: drain water, Ws: water surface, Wa: portion of drain water raised from water surface thereof

The invention claimed is:

1. A drainage pump comprising:

a housing;

an impeller housed in the housing; and a motor with a drive shaft connected to the impeller, wherein the housing includes a suction pipe in a cylindrical shape extending in an up-and-down direction, wherein the suction pipe includes a suction port facing downward and a concave surface in an annular shape around the suction port, and wherein the suction port is disposed at a lower end of the suction pipe, and the concave surface is formed on a lower end surface of the suction pipe, the concave surface has a deepest part, an inner edge, and an outer edge, and the deepest part is disposed at a position that is higher than the inner edge and the outer edge in the up-and-down direction.

2. The drainage pump according to claim 1, wherein a wall thickness at the lower end of the suction pipe in a radial direction is greater than or equal to 2.5 mm and less than or equal to 8 mm.

3. The drainage pump according to claim 1, wherein the concave surface extends from an inner peripheral edge to an outer peripheral edge of the lower end surface of the suction pipe and a width of the concave surface in a radial direction is equal to a thickness of the suction pipe.

4. The drainage pump according to claim 1, wherein an outer diameter of the suction pipe is greater than or equal to 16 mm and less than or equal to 25 mm.

5. The drainage pump according to claim 1, wherein the concave surface faces downward.

* * * * *